United States Patent [19]

Jones

[11] Patent Number: 5,044,631

[45] Date of Patent: Sep. 3, 1991

[54] DECLINE PRESS EXERCISE MACHINE

[75] Inventor: Gary A. Jones, Falmouth, Ky.

[73] Assignee: Hammer Corporation

[21] Appl. No.: 540,843

[22] Filed: Jun. 20, 1990

[51] Int. Cl.[5] ..... A63B 21/00; A63B 21/22

[52] U.S. Cl. ..... 272/134; 272/132; 272/144; 128/25 R

[58] Field of Search ..... 272/118, 134, 117, 116, 272/DIG. 4, 141, 71, 73

[56] References Cited

U.S. PATENT DOCUMENTS

| | | | |
|---|---|---|---|
| 3,858,873 | 1/1975 | Jones . | |
| 3,998,454 | 12/1976 | Jones . | |
| 4,720,099 | 1/1988 | Carlson | 272/134 |
| 4,854,578 | 8/1989 | Fulks | 272/134 |

OTHER PUBLICATIONS

Nautilus Midwest, brochure.

*Primary Examiner*—Richard J. Apley
*Assistant Examiner*—Jerome W. Donnolly
*Attorney, Agent, or Firm*—Wood, Herron & Evans

[57] ABSTRACT

An exercise machine for performing a decline press includes a frame, a declined seat connected to the frame and two independently maneuverable levers with upper rearward ends pivotally connected to the frame above the seat. The lower, forward ends of the levers are adapted to hold removable weights. Arms extend downwardly and rearwardly from the levers and angled handles are connected to the bottoms of the arms, each handle adapted to be grasped by a person supported on the seat and then pressed forwardly and upwardly in an arcuate path along a vertical plane that converges inwardly with respect to the front of the declined seat. This decline press exercise machine accommodates the natural musculoskeletal movements of the arms and shoulders of a person, thereby maximizing muscular benefit while minimizing joint stress.

23 Claims, 5 Drawing Sheets

DECLINE PRESS EXERCISE MACHINE

FIELD OF THE INVENTION

This invention relates to a decline press exercise machine that accommodates the natural musculoskeletal makeup of a person.

BACKGROUND OF THE INVENTION

Many athletes and non-athletes utilize weight lifting or weight training exercises to build strength and/or bulk, to prevent injury, or to improve overall condition and appearance. Typically, weight training exercises are performed with either exercise machines or free weights, i.e., barbells and weighted plates, dumbbells, etc. For various reasons, most exercise programs incorporate both machines and free weights in a variety of different exercise routines in order to maximize the effect of working out a desired number of muscle groups.

Free weights offer a number of advantages over exercise machines. For instance, they are relatively inexpensive in comparison to exercise machines. Free weights are also more versatile because a variety of exercises can be performed with one set of weights, whereas most exercise machines are designed for only one exercise. Even though some exercise machines accommodate more than one exercise, the cost of these machines usually increases proportionately with the number of exercises. Use of dumbbells also enables both arms to be exercised independently. Finally, free weights are popular among many weight lifters because the lifting movements are not restricted to prescribed planes of motion or prescribed angles.

Nevertheless, there are also a number of inherent disadvantages associated with free weights. One such disadvantage relates to safety. Although most weight room instructors strongly advise against an individual working out by himself or herself, this cautionary measure is particularly important when the lifting of free weights is involved. This is due to commonly recognized dangers such as the possibility of dropping a weight on a body part, or becoming trapped beneath a bar, which could easily occur in exercises such as bench press, incline press or squat. Additionally, through carelessness, loading and unloading of heavy weighted plates onto the ends of a bar sometimes results in an unbalanced bar that falls downward from its rack.

Another danger associated with some free weight exercises relates to the body positioning required to perform a prescribed maneuver. For instance, the most efficient manner of performing a decline press is from the floor, in a neck bridged position, with the barbell or dumbbell handed to the exerciser over his or her head. The barbell is then pressed upwardly in a direction that is substantially parallel with the rearwardly arched chest. This exercise, although beneficial from a purely muscular viewpoint, is seldom performed because of the danger and/or awkwardness involved with positioning of the body and receiving the barbell. For these same reasons, this exercise is almost never performed as part of a rehabilitation program.

Another disadvantage associated with free weights relates to the fact that the weight resistance, or opposing force, that is exercised against is always directed vertically downward by gravity. Yet, the moment arm of the weight about the pivot point varies considerably throughout the full range of motion. This principle is explained in U.S. Pat. No. 3,998,454 with respect to a commonly performed exercise referred to as the dumbbell bicep curl. In short, during this exercise the applied moment arm about the elbow varies according to the sine of the angle of the lower arm with respect to the vertically oriented upper arm. The moment arm is greatest when the angle is 90°, and it is lowest when the angle is 180° and 0°.

If the resistance capabilities of the muscles of the human body matched this moment arm, the degree of difficulty experienced by the exerciser would be uniform, or balanced, throughout the entire range of motion. However, as reported in U.S. Pat. No. 3,998,454, the strength generated by the human muscles during this exercise is not in fact "balanced" throughout the range of motion, and there are some "sticking points" of increased difficulty. As a result, maximum benefits are not achieved when performing a bicep curl with a dumbbell.

A pullover machine disclosed in U.S. Pat. No. 3,998,454 utilizes an eccentric cam to vary weight resistance over the range of motion for the muscles utilized in a pullover maneuver. Over the years, for various muscle groups, a number of these cam and chain machines have been designed in an attempt to match a resistance variation through a range of motion with the natural strength curve for a particular muscle group associated with the range of motion. To the extent that these machines actually do succeed in approximating a resistance variation to an appropriate strength curve, an improvement over lifting of free weights probably has been achieved.

As a result, applicant has recognized that a machine, rather than free weights, must be employed to advance the state of the art with respect to manipulating resistance variation to match a strength curve for a particular range of motion. Nevertheless, there are a number of practical disadvantages associated with cam and chain machines. These disadvantages are outlined in applicant's copending applications, entitled "Pulldown Exercise Machine" and "Dumbbell Press Exercise Machine," filed on Apr. 26, 1990, Ser. Nos. 07/514,869 and 07/514,839. Moreover, applicant is unaware of any decline press exercise machine that effectively and safely exercises the triceps, the shoulders and the pectoral muscles from a declined position.

Although one cam and chain machine requires outward pushing, from a declined, seated position, of bottom-pivoted levers along planes that are parallel to the seat, this machine does not work the decline press muscle group as effectively or in the same manner as the neck-bridge free weight decline press maneuver described above. This machine also suffers from problems that seem to be inherent to these cam and chain machines. That is, as explained in applicant's above-cited patent applications, this cam and chain exercise machine does not quite fit the body with respect to the prescribed exercise motion. In short, neither this machine with a declined seat nor any other prior machine of which applicant is aware adequately fulfill the genuine need for a decline press exercise machine.

It is therefore an object of the invention to provide a decline press exercise machine that maximizes the exercise benefit attainable during a decline press maneuver while minimizing skeletal or joint stress associated therewith.

It is another object of the invention to provide a decline press exercise machine which combines the advantageous features of both free weight exercise and exercise machines without incorporating the attendant disadvantages normally associated therewith.

It is still another object of the invention to provide a decline press exercise machine which is particularly suitable for exercising one arm at a time.

SUMMARY OF THE INVENTION

This invention contemplates a decline press exercise machine that includes a frame which supports a declined seat and weight supporting levers that are pivotally connected to the frame above the seat. The lower ends of the levers are adapted to be moved upwardly and forwardly by a person declined on the seat, against the resistance of the supported weights, to provide decline press exercise that is advantageous for the triceps, the shoulders and the pectoral muscles. This decline press exercise machine facilitates safe and efficient performance of a declined press exercise because it accommodates the natural musculoskeletal makeup of the human body.

More particularly, the natural musculoskeletal makeup of the body is accommodated by the structural orientation of the levers, the lever axes, arms extending from the levers and handles connected to the arms. The particular combination of all of these structural aspects results in a machine which, based upon feedback from a number of individuals involved in the field of strength training, more naturally couples the muscular exertion of the declined press motion against a preselected weight resistance and in a direction of motion that is compatible with the musculoskeletal structural makeup of the body.

Because it has two independently pivotal levers, this decline press machine enables the performance of either simultaneous or alternate exercise of both arms. This feature is particularly advantageous in monitoring rehabilitation progress after an injury, where it is often necessary to compare the relative strengths of the arms.

In a related aspect of this feature, the angle of connection for the arm and the weights of the arms substantially counterbalance the weights of the lower forward ends of the respective levers. As a result, for each lever, the total moment about the pivot axis is close to zero, and the minimum weight that must be exercised against, i.e., with no weight plates supported, is very low. Therefore, and also because the pivotal lever has substantially no friction, the weights supported on the lever closely approximate the actual weight resistance that is exercised against. This feature becomes important during the initial stages of rehabilitation, when it may be required to exercise against very low weight resistance and keep highly accurate records of actual weight lifted.

In accordance with a preferred embodiment of the invention, a decline press exercise machine includes a frame, a declined seat connected to the frame and two levers having upper, rearward ends pivotally connected to the frame. Lower, forward ends of the levers include hubs for holding weighted plates. Arms extend downwardly from the levers, and handles connected to the arms are angled outwardly from the seat and downwardly toward a vertical midplane that bisects the seat, thereby to provide a natural grasping position for coupling the applied, declined pressing force to two outer converging vertical planes of lever motion. That is, the levers pivot along outer vertical planes that converge forwardly with respect to the forward facing direction of the seat, or with respect to the vertical midplane that bisects the seat.

These outer vertical planes naturally accommodate the structure of the human body relative to the pressing motion utilized in a decline press. As a result, a person supported on the seat is able to maximize the muscular benefits attainable by performing a decline press exercise, while minimizing joint stress. Use of this invention provides exercise for a muscle group that includes the triceps, the shoulders and the pectoral muscles, and it does so in a manner that does not stress joints or skeletal structure associated with this muscle group.

The structural orientation of this decline press exercise machine evolved from applicant's belief that most exercise machines oversimplify the musculoskeletal movements of the human body. While his accumulated years of observing and analyzing athletic movements of the body led him to conclude that most musculoskeletal movements are rather complex and involve multiple joints and multiple degrees of freedom, he also recognized that most exercise machines require bodily movement in directions or planes that are oriented simply at right angles or parallel to the torso of the body. Based on these observations, and bolstered by his opinion that the ultimate objective of any exercise machine is to provide maximum muscular benefit with minimum joint stress, applicant perceived a need for improvement in the design of exercise machines and began working toward that goal. Feedback from athletes who have used this inventive decline press exercise machine have confirmed that it constitutes a marked improvement over pre-existing machines or free weight methods for performing a decline press.

This decline press machine provides the benefits of both free weight exercise and exercise with weight machines, without incorporating the attendant disadvantages commonly associated with these methods of exercising.

With this machine, for persons of average size, the moment arm about the pivot point is lowest upon initiation of the pressing motion and the moment arm increases gradually throughout the motion until the arm is parallel with the ground. For other persons, or those with longer arms, the moment arm about the pivot point begins decreasing again from the maximum value as the arm is rotated above the parallel position.

These and other features of the invention will be more readily understood in view of the following detailed description and the drawings in which:

DETAILED DESCRIPTION OF THE DRAWINGS

Figure 1:
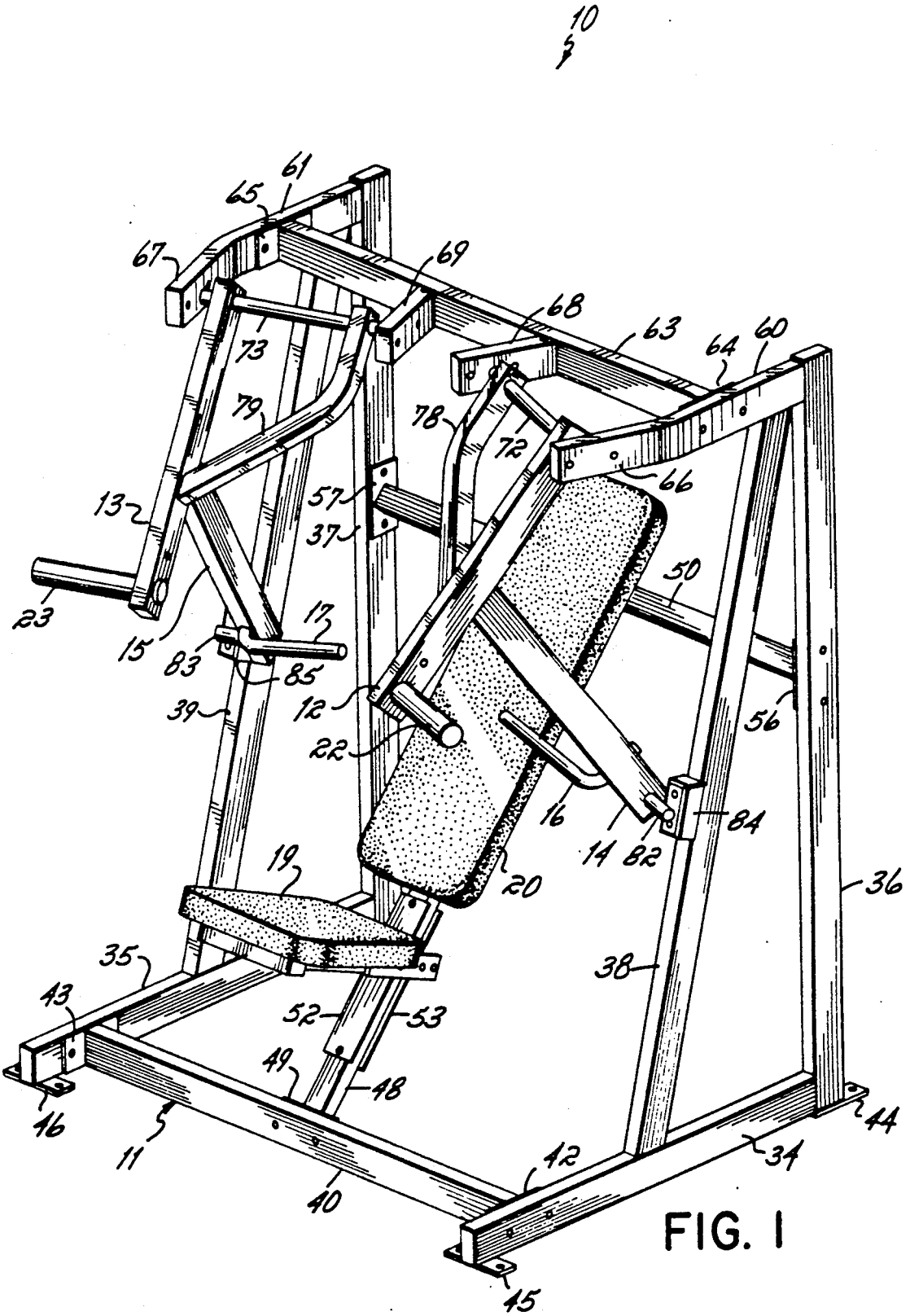
FIG. 1 is a perspective view of a dumbbell exercise machine in accordance with a preferred embodiment of the invention.

FIGS. 1–4 show a decline press exercise machine 10 in accordance with a preferred embodiment of the invention. This machine 10 includes a frame 11 made of a number of straight and/or curved sections of heavy duty steel that are either welded or bolted together, or pivotally connected. Exercise levers 12 and 13 are pivotally connected to the frame 11 at their upper rearward ends. Arms 14 and 15 extend downwardly and rearwardly from levers 12 and 13, respectively. Handles 16 and 17 are connected to the bottom ends of arms 14 and 15, respectively. The handles 16 and 17 are adapted to be grasped and pressed upwardly and forwardly by an operator supported in a declined position on a declined seat 19 and declined back rest 20. This declined pressing force applied at the handles 16 and 17 pivots levers 12 and 13, respectively, with respect to frame 11 against weight resistance provided by removable weight plates (not shown) supported on hubs 22 and 23, respectively, at the lower, forward ends of the levers.

The seat 19 and back rest 20 are bisected by a vertical midplane 25 (shown in FIG. 2) that extends through the middle of the frame 11. The frame 11 has two sides that are mirror images with respect to vertical midplane 25. Each side has a bottom support, a rear leg and a front leg. On the left side of the frame 11, as viewed by one supported on seat 19 and back rest 20, these parts are numbered 34, 36 and 38, respectively. Similarly, on the right side of frame 11 these parts are numbered 35, 37 and 39, respectively. Legs 38 and 39 are angled with respect to frame 11. This angle is designated by numeral 41 in FIG. 4, and is preferably about 75°. The metal sections forming the sides are preferably connected together by welds.

Sides 34 and 35 are connected to a forward base section 40. Preferably, connection is made by bolts (not shown) tightened through end plates 42 and 43 that are welded to section 40. The frame 11 is also supported at its corners by welded bottom plates 44, 45, 46 and 47 (see FIG. 2 for plate 47). Preferably, the bottom plates have bolt holes for optional securement of the machine 10 to a portable base.

Figure 4:
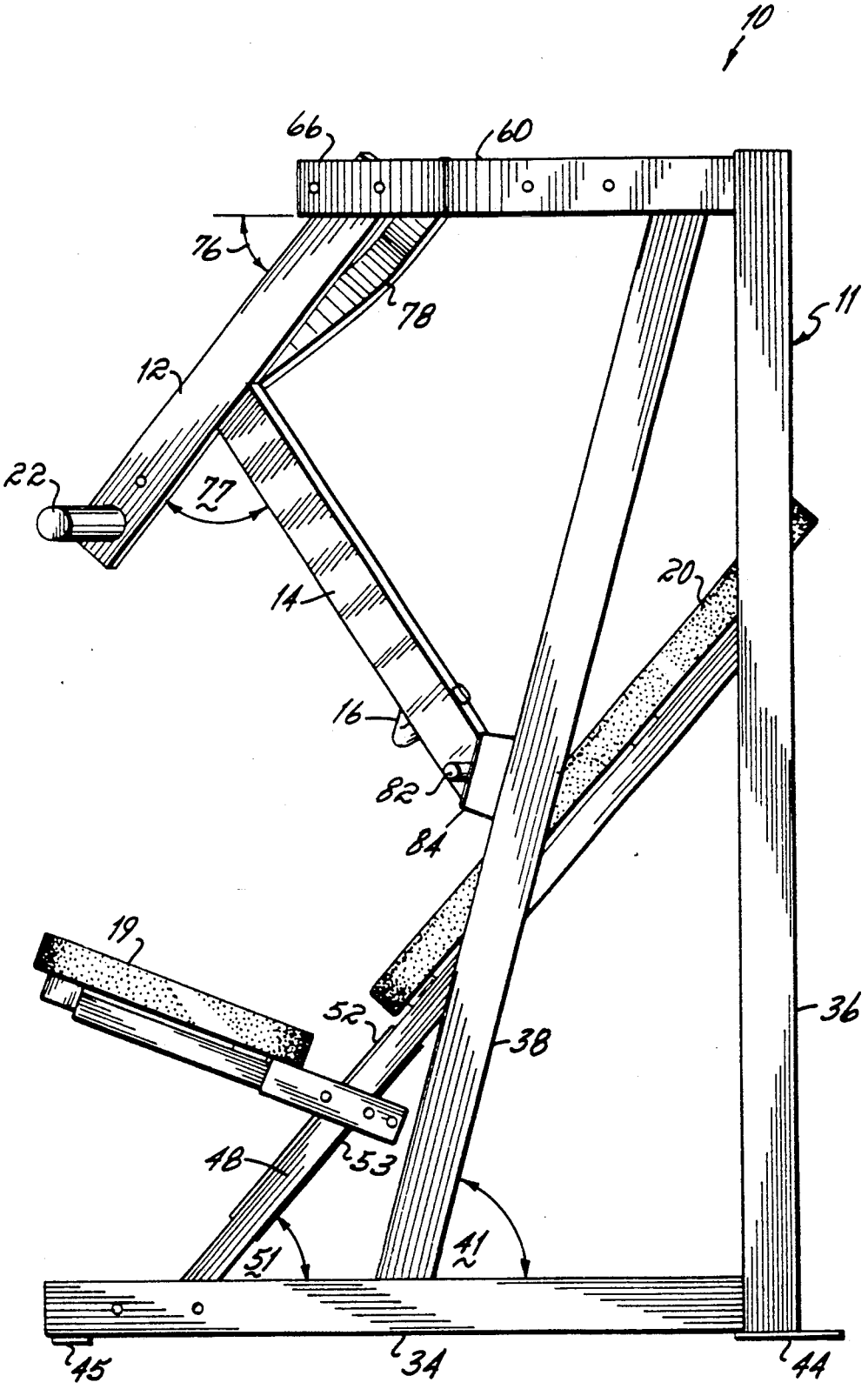
FIG. 4 is a side view of the dumbbell press exercise machine shown in FIG. 1.

Seat 19 and back rest 20 are connected to a central leg 48 that extends along vertical midplane 25. Central leg 48 has an end plate 49 welded at its bottom end, which is in turn secured to support 40. The top of center leg 48 is supported by transverse brace 50, at an angle designated by numeral 51, as shown in FIG. 4. Preferably, this angle is about 45°.

The seat 19 is preferably adjustable upwardly or downwardly along leg 48. Adjustment is provided by frictional engagement between parallel spaced bars (not shown) connected to seat 19 and two planar pieces 52 and 53 that are secured to central leg 48 in a sandwiching arrangement. To raise or lower the seat 19, a forward end of the seat 19 is tilted rearwardly, or upwardly with respect to central leg 48 so that the spaced parallel bars move away from, or provide clearance from pieces 52 and 53. In this orientation, the seat 19 may be moved upwardly or downwardly along the planar pieces, parallel to leg 48. When the forward end is subsequently tilted downwardly, the parallel bars of seat 19 will frictionally engage the pads. Any number of other methods for providing adjustability for seat 19 along leg 48 would be equally suitable.

Preferably, transverse brace 50 has plates 56 and 57 welded to its ends, and the plates are bolted to rear legs 36 and 37, respectively. Upper supports 60 and 61 connect to legs 36 and 38, and legs 37 and 39, respectively. An upper transverse brace 63 is connected between supports 60 and 61, preferably via end plates 64 and 65, in a manner similar to brace 50.

Figure 2A:
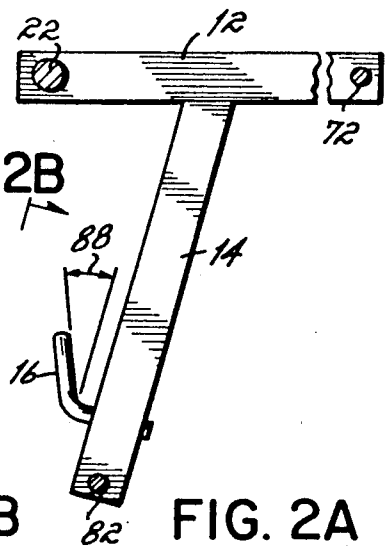
FIG. 2A is a view taken along lines 2A—2A of FIG. 2.
Figure 2B:
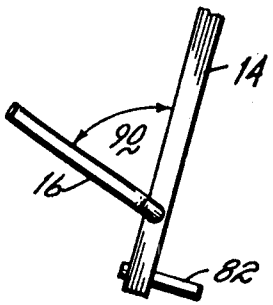
FIG. 2B is a view taken along lines 2B—2B of FIG. 2A.
Figure 2:
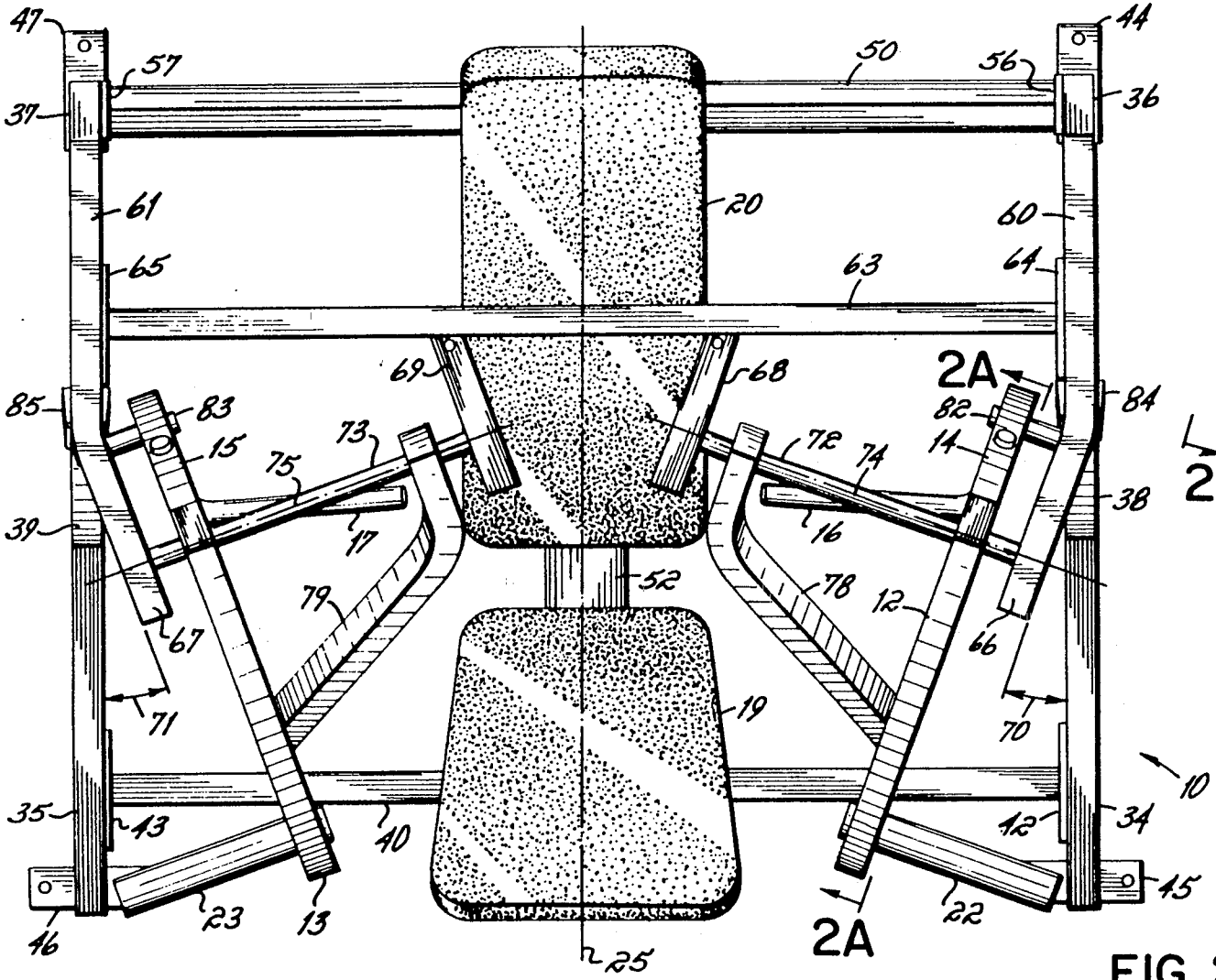
FIG. 2 is a top view of the dumbbell press exercise machine shown in FIG. 1.
Figure 3:
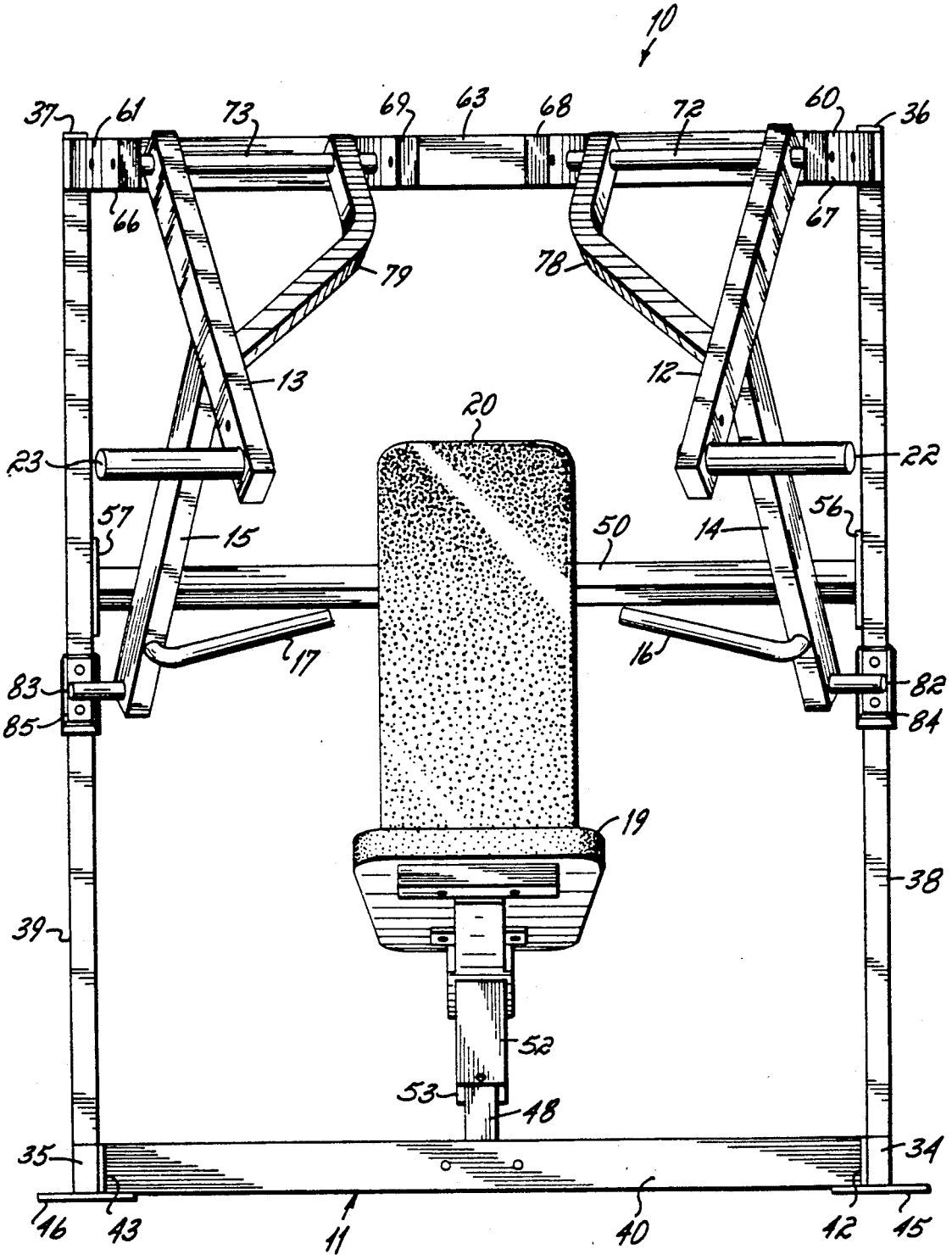
FIG. 3 is a front view of the dumbbell press exercise machine shown in FIG. 1.

Forward portions 66 and 67 of supports 60 and 61, respectively, are bent inwardly toward midplane 25 (FIG. 2). Along with two members, 68 and 69, that are each connected to transverse brace 63 at an angled orientation with respect to midplane 25, portions 66 and 67 dictate the axes of pivotal connection of levers 12 and 13, respectively. These angles of orientation are designated by numerals 70 and 71, respectively, as shown in FIG. 2, and are preferably about 20°. These angles 70 and 71 correspond to the angles of convergence of the vertical planes through which the levers move. Lever 12 includes an axle 72 aligned along an axis of connection 74, while lever 13 includes a axle 73 aligned along an axis of connection 75. These angles and axes are also shown most clearly in FIG. 2.

The axles 72 and 73 are connected to frame 11 by bearings. A pillow block bearing sold by Browning, Part No. VF 2S 116 has proved suitable. These bearings require maintenance only once a year, maintenance which consists of one shot of lubricating oil. For additional strength and stability, levers 12 and 13 include stabilizing braces 78 and 79, respectively. A peg 82 connected to arm 14 coacts with a rubber stop 84 mounted to leg 38 to limit downward pivotal movement of lever 12. Similarly, a peg 83 connected to arm 15 coacts with a rubber stop 85 connected to leg 39 to limit downward pivotal movement of lever 13.

Each lever 13 preferably has a length of about 28 7/64", and is oriented downwardly at an initial angle designated by numeral 76 in FIG. 4. Preferably, the angle is about 50°. At a predetermined distance between the top and bottom ends of the lever, preferably about 10 9/64" from the bottom of the lever, the arm 14 is connected to the lever 12 at an angle designated by numeral 77, as shown in FIG. 4. Preferably, this angle is about 60°. Although not shown in FIG. 4, lever 13 and arm 15 are mirror images of lever 12 and arm 14 with respect to plane 25. The arms 14 and 15 preferably have lengths of about 26". The handles 16 and 17 are outwardly and downwardly angled with respect to the arms 14 and 15, respectively. As shown in FIG. 2A with respect to lever 12, the handle 18 is angled outwardly from arm 14 at an angle designated by numeral 88, preferably at an angle of about 20°. In this context, "outwardly" means in the direction away from a person sitting in the seat. As shown in FIG. 2B, handle 18 is also angled downwardly from the arm 14 toward the midplane 25 at an angle designated by numeral 90, preferably at an angle of about 70°. Although not shown in the Figures, handle 17 is also outwardly and downwardly angled with respect to arm 15. The angles of the handles couple natural grasping positions for the hands to the converging planes, thereby enabling motive force to be applied through a decline press in converging planes that naturally accommodate the musculoskeletal structure of a human being.

As mentioned previously, frame 11 enables a person to perform a decline press exercise, either simultaneously with both arms or independently, a feature which is particularly desirable for rehabilitation.

Figure 5:
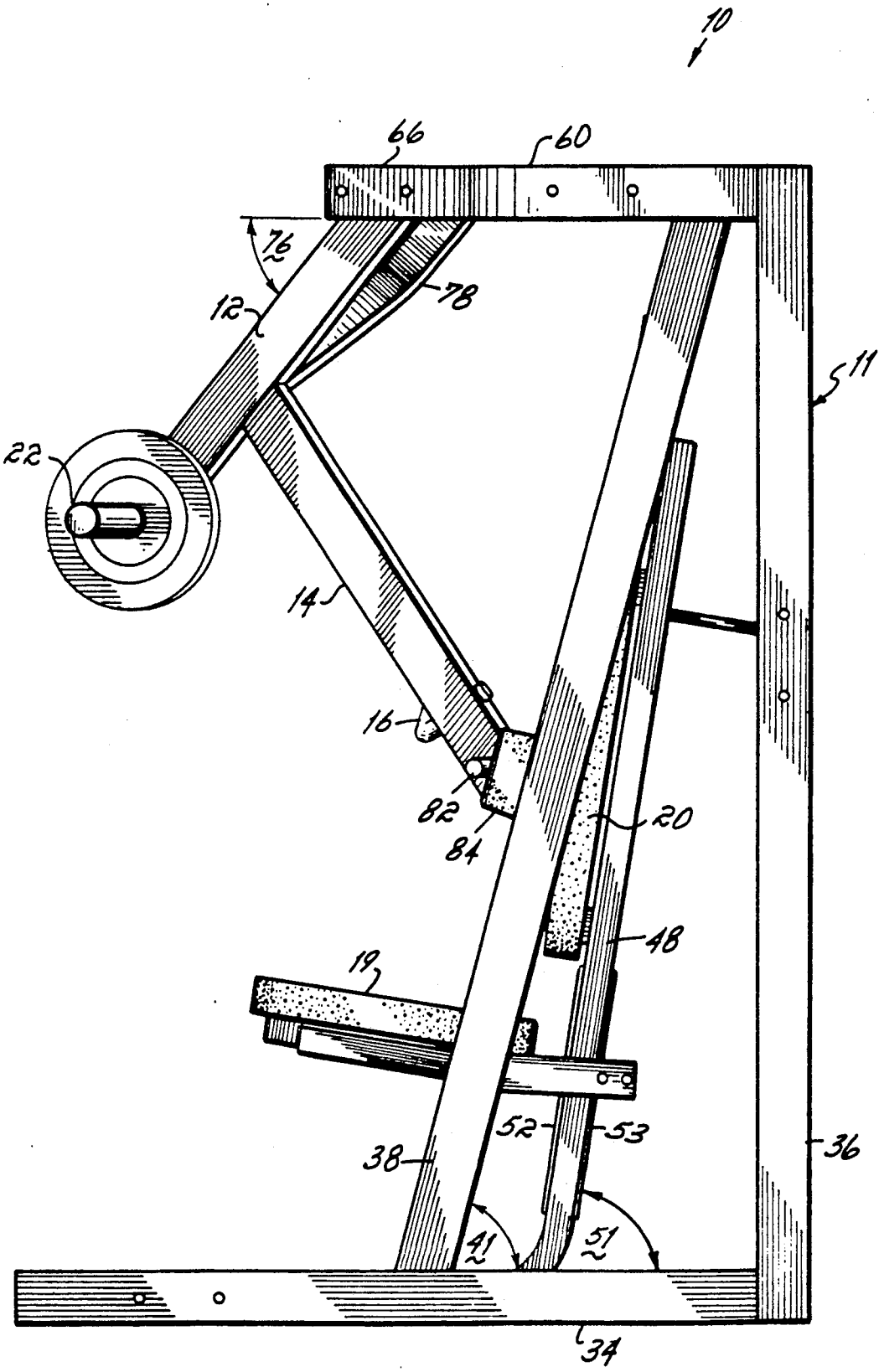
FIG. 5 shows a side view, similar to FIG. 4, of an alternate embodiment of the invention.

An alternate embodiment of the invention is shown in FIG. 5. The only structural difference between this embodiment and the preferred embodiment is the angle 51 of connection for central section leg 48 with respect to the frame 11. The angle of connection shown in FIG. 5 is about 80 . This angular difference of leg section 48 places the declined seat 19 and the declined back support 20 in more of a straight up position, or about 10° for vertical. The angular relationship between the seat 19 and the back rest 20 is also closer to a right angle than the angular relationship shown in FIG. 4. The subtle structural differences of the angle of central leg 48 and the seat angle affect the muscle group that is exercised during a pressing motion. The exercise performed on the machine 10 shown in FIG. 5 is more in the nature of a bench press performed from a seated position, rather than what is commonly referred to as a decline press, which is the exercise simulated by the machine depicted in FIGS. 1–4. Nevertheless, applicant has learned that the structural orientation of the levers, the lever axes, the arms, the handles, and the planes of motion for the exercise machine shown in FIG. 1–4 is also particularly suitable for the exercise machine shown in FIG. 5.

For example, applicant's observations of the bench press exercise performed with free weights seemed to indicate that movement is usually not in an upward vertical direction rather along a slightly diagonal path in the direction of or toward the head. The exercise machine shown in FIG. 5 successfully mimics this observed bench press motion, thereby producing a feel that genuinely simulates a bench press performed with free weights, a feel that most athletes are accustomed to.

For either embodiment, the moment arm about the pivot point through the duration of the pressing maneuver is related to the sine of the angle of lever 12 with respect to vertical. Initially, this angle is 40°, or the complement of angle 76. As this complement angle approaches 90°, the exercise becomes increasingly difficult. Past 90°, the moment arm again decreases. However, most persons are neither tall enough nor have long enough arms to move the lever past this 90°position. This invention provides a decline press exercise machine that couples a varying moment arm to a pressing exercise performed from a declined, seated position, the moment arm varying according to the first quarter of a sine wave for most persons.

This machine provides a moment arm increase that substantially matches the physical strength curve for a decline press maneuver, because as the arms of a person are extended from the body of a person towards the "lock out" position, the physical resistance capabilities increase tremendously. Thus, for most individuals, the degree of difficulty remains relatively constant throughout the exercise and there are no "sticking points."

It is also to be understood that the strength curve for a declined pressing maneuver is related to the angle of push, which is determined by the seat angle and the arm length of the person exercising. For this machine, the angle of push is relatively constant throughout.

While two embodiments of the invention have been described, it is to be understood that the invention is not limited thereby and that in light of the present disclosure, various other alternative embodiments will be apparent to a person skilled in the art. For instance, the structural orientation of some parts or portion of the frame 11 is not critical, so long as the positioning of the lever pivot points, the lever lengths, the arm, the handles and the vertical planes of motion are maintained. Additionally, while the particular angles shown are considered to be optimum at this point in time, based upon feedback from those involved in strength training, it is entirely possible that some further refinements may evolve. Accordingly, it is to be understood that changes may be made without departing from the scope of the invention as particularly set forth and claimed.

I claim:

1. A decline press exercise machine comprising:

a frame;

a declined seat connected to the frame and adapted to support a person in a declined seated position straddling a centered vertical plane;

a lever having two ends, an upper rearward end of the lever connected to the frame for pivotal movement about an axis located above the seat and along an outer vertical plane that converges toward said centered vertical plane, the lever also having a lower, forward end adapted to hold a removable weight;

an arm extending downwardly and rearwardly from the lever; and a handle connected to a bottom end of the arm and adapted to be grasped and pressed forwardly and upwardly in an arcuate direction by a person supported on said seat, thereby to pivot the lever through the outer vertical plane.

2. The decline press exercise machine of claim 1 and further comprising:

a second lever pivotally connected to the frame, the second lever being a mirror image of the first lever with respect to the centered vertical plane and also having an arm and a handle connected thereto, the handle of said second lever adapted to be grasped and pressed forwardly and upwardly in an arcuate direction through a second outer vertical plane that also converges toward the centered vertical plane.

3. The decline press exercise machine of claim 1 wherein said handle extends at an upwardly and outwardly directed angle with respect to said arm.

4. The decline press exercise machine of claim 1 and further comprising:

stop means connected to said frame for coacting with said arm to limit downward pivotal movement of the lever with respect to the frame.

5. The decline press exercise machine of claim 1 wherein said outer vertical plane converges toward said centered vertical plane at an angle of about 20°.

6. The decline press exercise machine of claim 3 wherein said a starting position of lever is oriented at an angle of about 50° from horizontal.

7. The decline press exercise machine of claim 1 wherein said arm is oriented downward at an angle of about 60° with respect to the lever.

8. The decline press exercise machine of claim 3 wherein said handle angles downwardly from said arm toward said centered vertical plane at an angle of about 70°.

9. The decline press exercise machine of claim 3 wherein said handle extends outwardly with respect to said arm at an angle of about 20°.

10. The decline press exercise machine of claim 1 wherein said seat is declined from said frame at an angle of about 45° from vertical.

11. The decline press exercise machine of claim 1 wherein said seat is declined from said frame at an angle of about 10° from vertical.

12. A decline press exercise machine comprising:
a frame;
a declined seat connected to the frame and adapted to support a person in a declined seated position straddling a central vertical plane;
two levers, each lever connected to the frame at an upper rearward end thereof and pivotal through an outer vertical plane that converges toward the central vertical plane, each lever also having a lower forward end adapted to hold a removable weight;
two arms, each arm extending downwardly from a lever; and
two handles, each handle connected to a bottom end of an arm and adapted to be grasped and pressed forwardly and upwardly in an arcuate direction by a person supported on the seat, whereby said pressing pivots the levers along the respective outer vertical planes against a predetermined weight resistance provided by the removable weights held at said lower, forward ends, the levers being independently pivotal to provide simultaneous and/or independent decline press exercise along said converging planes.

13. The decline press exercise machine of claim 12 wherein the axes of pivotal motion of the levers are located above the seat.

14. The decline press exercise machine of claim 12 wherein each lever has an at rest portion oriented downwardly at an angle of about 50° with respect to the frame.

15. The decline press exercise machine of claim 12 wherein each arm extends downwardly from a respective lever at an angle of about 60°.

16. The decline press exercise machine of claim 12 wherein each said handle angles downwardly from a respective arm toward said central plane at an angle of about 70°.

17. The decline press exercise machine of claim 12 wherein each said handle angles outwardly from said seat at an angle of about 20°.

18. The decline press exercise machine of claim 12 wherein each outer vertical plane is oriented at an angle of about 20° with respect to the central vertical plane.

19. The decline press exercise machine of claim 12 wherein each lever further comprises:
stop means for coacting with a pad mounted to the frame to limit downward pivotal motion of said lower forward end.

20. The decline press exercise machine of claim 12 wherein said seat is declined from said frame at a angle of about 45° from vertical.

21. The decline press exercise machine of claim 12 wherein said seat is declined from said frame at an angle of about 10° from vertical.

22. A decline press exercise machine comprising:
a frame having a front;
a declined seat connected to the frame and adapted to support a person in a declined position facing the front of the frame; and
decline press exercise means pivotally connected to the frame for providing, for a person supported in a declined position on the seat, exercise via an upward and outward pressing motion against a selectable weight resistance, the pressing motion producing movement along a vertical plane that converges forwardly with respect to the front of the frame.

23. The exercise machine of claim 22 wherein each said vertical plane converges at an angle of about 20°.

* * * * *